United States Patent [19]

Ecker

[11] 4,036,294

[45] July 19, 1977

[54] HEAT EXCHANGER ASSEMBLY DESIGNED AS A LONGITUDINAL COUNTERFLOW DEVICE

[75] Inventor: Hans Ecker, Ludwigshafen, Germany

[73] Assignee: Hochtemperatur-Reaktorbau GmbH, Cologne, Germany

[21] Appl. No.: 677,237

[22] Filed: Apr. 15, 1976

[30] Foreign Application Priority Data

Apr. 22, 1975 Germany ..... 2517693

[51] Int. Cl.[2] ..... F28D 7/10

[52] U.S. Cl. ..... 165/154; 165/157; 165/164; 165/168

[58] Field of Search ..... 165/154, 157, 164, 168

*Primary Examiner*—Carroll B. Dority, Jr.
*Assistant Examiner*—Daniel J. O'Connor
*Attorney, Agent, or Firm*—Toren, McGeady and Stanger

[57] ABSTRACT

A heat exchanger assembly of the counterflow type having a vertically extending longitudinal configuration is constructed from a plurality of individual tube nests, with each of the nests formed of a plurality of individual tubes adapted to have a first heat exchange medium flow therethrough. The upper and lower ends of the tubes are connected to tube plates and a guide shell is provided surrounding each of the tube nests for effecting therein flow of a secondary heat exchange medium around the individual tubes of each nest. Each of the tube nests is formed by its associated guide shell and tube plates as an individual box with the boxes thus formed when viewed in a plane extending transversely to the longitudinal direction of the heat exchanger assembly being arranged as a hexagonal grid. The tube plates are positioned in a staggered arrangement with each tube plate longitudinally spaced from an adjacent tube plate so that they may be overlapping when seen in plan view thereby reducing the space requirements of the overall assembly. The boxes are welded to a supporting structure located in the bottom region of the assembly and a housing is provided surrounding the hexagonal grid of boxes in order to form together with the supporting structure a tight joint to enclose the assembly. A central guide shell located within the midsection of the hexagonal grid and surrounded by the boxes encloses therein a plurality of return tubes for returning to the tubes of the tube nests a first heat exchange medium flowing therethrough. The central guide shell is enclosed by a hood through which the return tubes extend with the return tubes being welded to the hood.

11 Claims, 9 Drawing Figures

FIG. 1a

HEAT EXCHANGER ASSEMBLY DESIGNED AS A LONGITUDINAL COUNTERFLOW DEVICE

BACKGROUND OF THE INVENTION

The present invention relates generally to the overall structuring of heat exchangers and more particularly to a structure for a heat exchanger assembly of the counterflow type having a longitudinal configuration. More specifically, the invention relates to the type of heat exchanger assembly wherein groups of tubes are arranged to form a plurality of nests of such tubes, with the individual tubes of each nest being connected at their ends with a tube plate and with each of the nests surrounded by a guide shell which permits a heat exchange medium flowing around the outside of the tubes to be introduced and exhausted from each of the tube nests.

DISCUSSION OF THE PRIOR ART

In the prior art several examples of the type of device to which the present invention relates are known. In German DOS No. 2,320,082 there is disclosed a heat exchanger composed of a plurality of tubes arranged parallel to the longitudinal axis of the exchanger in such a way that an annular cylindrical form is obtained for the heat exchanger surfaces. The secondary medium in such an exchanger is first conducted downwardly through a central tube from which it enters the tubes of the exchanger wherein it traverses the tubes from the bottom to the top thereof. The primary medium is conducted downwardly along the tubes in a counterflow pattern and enters at the top of a casing which surrounds the tubes over the major part of their length and which defines a flow chamber having a circular cross sectional configuration.

Another heat exchanger of the prior art having a circular cross section and having tubes arranged parallel to its longitudinal axis is represented in German DOS No. 2,320,083. This type of exchanger also has a flow chamber with a circular cross section and a plurality of tubes surrounding a central pipe. In this case, the central pipe also serves to supply the secondary medium which enters the tubes from the bottom. The flow chamber is bonded toward its exterior by a casing upon which there is attached at the top a perforated plate. The primary medium is conducted through this plate into the flow chamber in which it flows downwardly in a counterflow pattern relative to the secondary medium flowing in the tubes. The primary medium then issues again from the flow chamber through openings in the casing.

Still another example of a prior art arrangement is shown in German DOS No. 1,401,666 which discloses a heat exchanger containing in a casting a number of nests of tubes or tube bodies which are composed of a plurality of tubes connected at their ends to tube plates. The tubes which are of a substantially straight configuration are spread in the immediate proximity of the tubes plates in such a way that they are uniformly distributed over the cross section of the casing over the major part of their length. In this way, the total volume of the heat exchanger may be maintained low for a given heat transfer line.

Another example of the prior art known from German DOS No. 2,120,544 involves a heat exchanger composed of individual parallel elements where the elements of nests of tubes have a round or polygonal cross section and are surrounded on both sides by open casings. The exchanger carries a plate in its bottom part within which jacket tubes are inserted in a flow-tight arrangement. The outer medium, e.g. waste gas arriving from a turbine, enters the heat exchanger laterally at the top and is conducted along the exchanger tubes inside of the jacket tubes which are open on both sides, with the direction of flow being opposite to that of the medium flowing in the tubes. The inner medium is fed through a manifold to the tubes of a nest of tubes and is collected in additional manifolds after passing through the tubes and before it issues from the heat exchanger through an outlet opening.

The present invention, which has been developed from the state of the art indicated in the foregoing, is based upon providing a solution to the problem of reducing the total volume in a heat exchanger of the type described above by effecting an arrangement of compact design. Furthermore, the formation of bypass flows is prevented by an easily producible heat exchanger medium flowing around the tubes so that the efficiency of the heat exchange action is increased.

SUMMARY OF THE INVENTION

The present invention may be briefly described as a heat exchanger assembly of the counterflow type having a vertically extending longitudinal configuration and comprising a plurality of individual tube nests, each of said nests being formed of a plurality of individual tubes adapted to have a first heat exchange medium flow therethrough. The tubes of each nest are connected at their ends to tube plates and a guide shell is provided surrounding each of the tube nests for effecting therein flow of a secondary heat exchanger medium around the individual tubes of each nest. Each of the tube nests is formed by its associated guide shell and tube plates as an individual box and the boxes thus formed when viewed in a plane extending transversely to the longitudinal direction of the heat exchanger are arranged as a hexagonal grid. The boxes are welded to a supporting structure which is provided in a location generally near the bottom region of the heat exchanger and a housing for the heat exchanger assembly surrounds the hexagonal grid of boxes and forms together with the supporting structure a tight joint to enclose the assembly. A central guide shell located centrally of the hexagonal grid and surrounded by the boxes encloses therein a plurality of return tubes for returning to the tubes forming the tube nests the heat exchange medium flowing therethrough. The central guide shell is enclosed by a hood through which the return tubes extend, with the return tubes being welded to the hood.

In order to conserve space, the tube plates are staggered with adjacent plates being spaced from each other in the longitudinal direction of the heat exchanger and with the plates overlapping when seen in plan view in order to enable a closer spacing of the tube nests.

The exchanger according to the present invention can be used with particular advantage as a precooler in a closed gas turbine circuit or in the primary circuit of a gas-cooled, high-temperature reactor with a helium turbine. The invention is particularly adapted to such an application since it combines good heat transfer properties with low overall volume due to the fact that the available space is well utilized by virtue of the arrangement of the boxes in a hexagonal grid. By subdividing the heat exchanger into individual boxes it is possible to shut down individual regions of the heat exchanger, when, for example, leaks or other problems occur.

The guide shells of each nest or box of tubes may have a round or a hexagonal cross sectional configuration with the hexagonal form providing a more favorable utilization of the available space. The tube plates into which the tubes of each nest are inserted are preferably formed with a shape adapted to the cross sectional form of the guide shells.

The heat exchanger according to the present invention operates on the counterflow principle. The levels of pressures, pressure differentials, temperatures and temperature differentials of the inner medium flowing through the tubes and of the outer medium flowing around the tubes within the guide shells of each box may be selected at random. The heat exchange media selected may be both gaseous and liquid, and they may be conducted through the tubes as high pressure or low pressure media.

The number of boxes which it is possible to arrange in the hexagonal grid may be obtained according to the following mathematical formula:

$$n = 6(1 + 2 + 3 + 4 + \ldots) = 6 \sum_{1}^{i} i,$$

where $i$ denotes the number of hexagons enclosed within the grid.

By welding the guide shells surrounding the tube nests on the supporting structure of the assembly, and by forming a tight connection between this supporting construction and the housing of the heat exchanger, as well as by welding the return tubes on the hood of the central guide shell, internal bypasses of the shell side of the individual boxes are positively avoided. This results in a reduced heating surface and in a reduction of the pressure loss thereby serving to improve the efficiency of the overall plant.

The supporting construction and the sealing area to prevent bypasses are arranged in a plane which is located as low as possible so that it extends in a range of the heat exchanger wherein low temperatures are encountered. This yields low thermal expansions and stresses for the supporting grate and the sealing area. A prerequisite of the device is that the heat emitting medium be introduced at the top into the heat exchanger.

In an advantageous further aspect of the invention, the tube plates are arranged on both sides of the nexts of tubes in at least three different planes extending perpendicularly to the central axis of the heat exchanger in such a way that adjoining nests of tubes are staggered with the tube plates overlapping when seen in plan view. The staggering of the tube plates permits a particularly effective utilization of space since the boxes may be packed very close together without hindering access of the medium flowing around the tubes to the guide shells of the boxes or the issuance of the medium from these guide shells.

Adjoining the round or hexagonal tube plates, which are designed as perforated plates, are collector hoods which in turn are connected to inlet and outlet pipe joints for the medium flowing in the tubes. The hoods may have either a hemispherical form when used in round tube plates, or, where hexagonal tube plates are involved, the hoods may have a transitional configuration extending from a hexagonal form into a hemispherical form. The hoods are joined between the inlets and outlets for the pipe connections for the inner medium.

As discussed above, the return of the medium flowing in the tubes is effected through return tubes which are arranged in the central guide shell of the heat exchanger. It is advantageous to arrange these tubes also in a hexagonal grid when seen in plan view for best utilization of the available space. The return tubes are connected to the outlet pipe joints through collector hoods by means of tubes which have a U-shaped configuration. In this region of the heat exchanger there is sufficient space available for such an arrangement of the tubes and it is thus possible to compensate thermal stresses appearing between the outlet pipe connection and the welds on the hoods of the central guide shell.

If the heat exchanger is to be used as a precooler in the primary circuit of a gas-cooled, high-temperature reactor with a helium turbine, the low pressure gas arriving from the turbine, which has been cooled in the recuperator, is preferably conducted at the top along the tubes through the guide shells of the tube nests while the heat absorbing medium, which is water, is conducted through the tubes and is fed to the latter from the bottom through the inlet pipe connections and collector hoods.

At their upper ends, the guide shells of the tube nests adjoin directly tube plates. In order to permit access of the heat-emitting medium to the boxes or tube nests, the guide shells are provided with a number of inlet slots distributed around their circmference. The bottom ends of the guide shells are open so that the medium may be exhausted therefrom in an unhindered fashion.

Below the inlet slots of each guide shell there is provided a cylinder which can be displaced upwardly to close or cover the inlet slots. For each of the cylinders of a guide shell, an actuating device is provided for controlling movement of the cylinder. In this manner, it is possible to shut the inlet passage of the heat-emitter medium into the guide shell and thus to shield individual boxes on the shell side, e.g., on the helium inside of the precooler associated with the primary circuit of the high-temperature reactor. This arrangement provides several advantages with regard to the thermodynamic layout of the heat exchanger.

If such a precooler is formed as a part of a nuclear power plant integrated in a prestressed concrete pressure tank, it is customary to install the device in a pod having a liner. A separate housing for the cooler is not necessary since the liner assumes this function. The supporting construction arranged in the bottom part of the heat exchanger bears directly upon the liner with the interposition of a thermosleeve provided on the liner. The thermosleeve performs the function of preventing the formation of thermal stresses. Additionally, the thermosleeve can be sealed at the bearing point of the supporting structure with a metal O-ring in order to improve the sealing effect.

The tubes for the supply and return of the medium flowing in the nests of tubes are preferably arranged in several vertical openings through the prestressed concrete pressure tank and are arranged on a pitch circle about the downwardy extended central axis of the precooler. If the precooler consists, for example, of 54 round boxes, ten such openings are provided of which one part receives the feed tubes with the other part receiving the return tubes for the inner medium, which is water. The openings are likewise provided with liners. The tubes of each opening are inserted into a perforated plate which is detachably connected with the respective liner over a thermosleeve. These separation points are provided as far on the top as possible within the openings, taking into account the problem of contamination, and the overhead space of the precooler is maintained as small as possible. For the same reason, the length of the feed tubes from the end of the precooler to the inlet pipe connection and of the return tubes from the end of the central guide shell to the end of the precooler, is maintained as small as possible.

In a precooler of the above-mentioned type, that is, a precooler installed in the pod of a prestressed concrete pressure tank, it is advisable to arrange the means for displacing the cylinder resting on the guide shells in the upper part of the prestressed concrete plug with which the pod is closed. Such means cooperate, for example, with a rope drive whose rope is branched above each collector hood and secured on the circumference of an associated cylinder at several points. Instead of a rope drive a chain arrangement, or other linkage means may also be used.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1A:
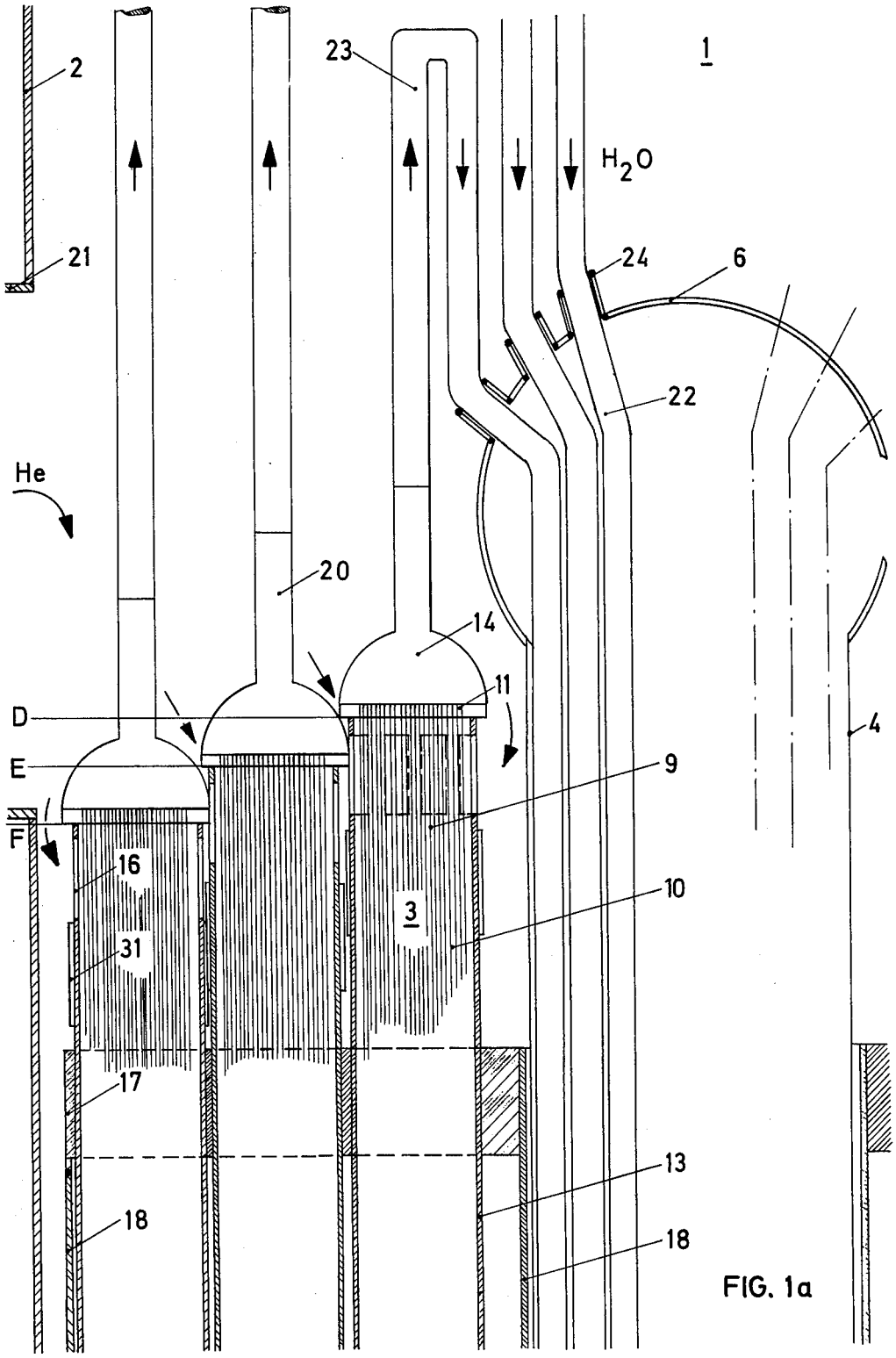
FIGS. 1*a* and 1*b* are both longitudinal sectional views showing, respectively, the upper and lower part of a precooler in accordance with the present invention.
Figure 1B:
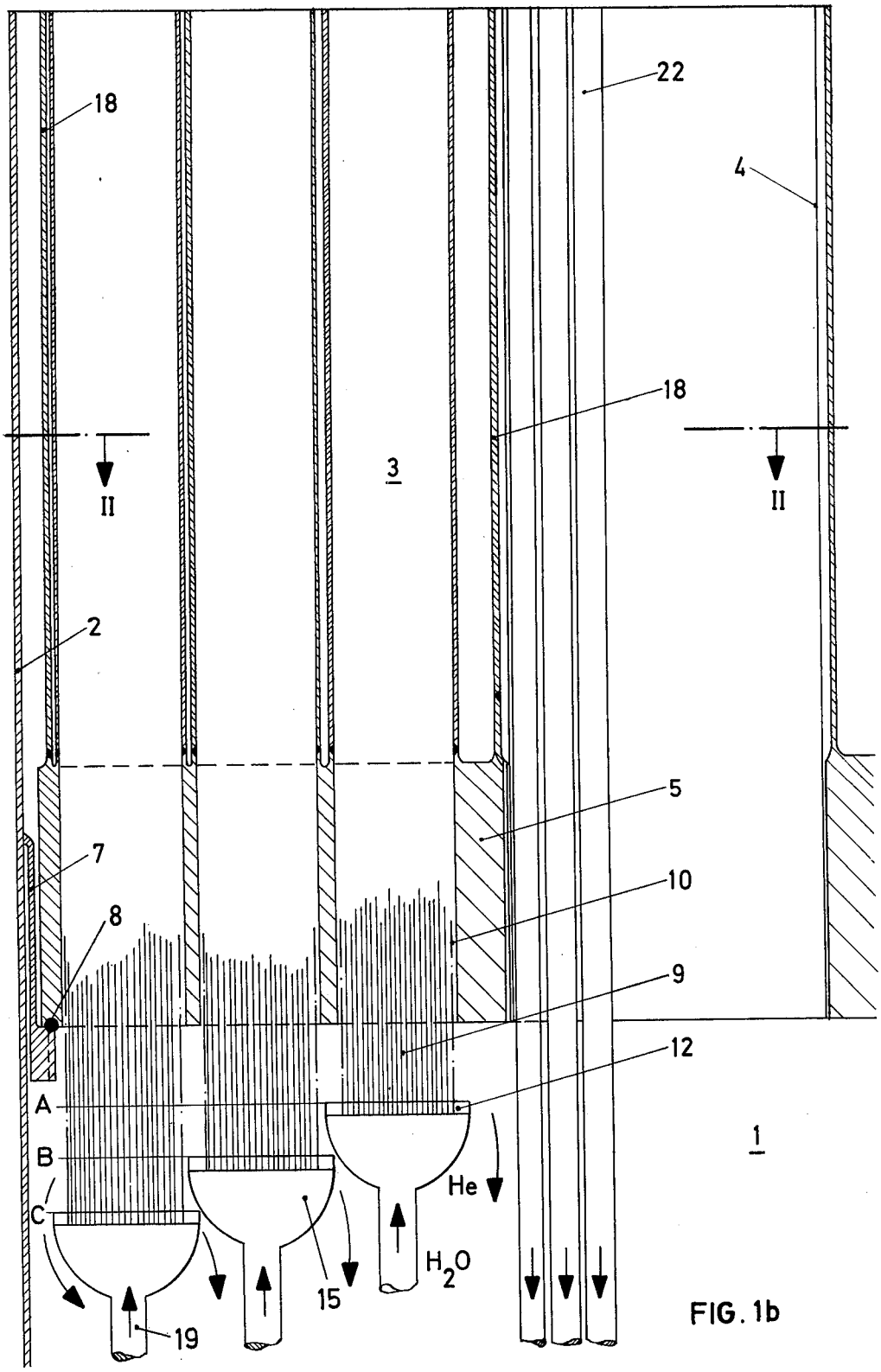

Referring now to the drawings, wherein like reference numerals are used to refer to similar parts throughout the various figures thereof, a heat exchanger assembly embodying the principles of the present invention is shown in FIGS. 1*a* and 1*b* as a precooler having a longitudinal vertical arrangement and arranged for operation with the primary circuit of a high temperature reactor having a helium turbine. The precooler is arranged, like all the other components of the circuit, in a vertical pod 1 located within a prestressed concrete pressure tank. The pod 1 is lined with a liner 2 of steel which forms at the same time the housing for the precooler. The precooler consists substantially of a plurality of boxes 3 having a round cross sectional configuration. A central guide shell 4 is provided and a supporting grate 5 is also shown. The central guide shell 4 is closed at its top by a spherical hood 6. The supporting grate 5, which is arranged within the bottom region of the precooler, bears upon a thermosleeve 7 provided on the liner 2. The bearing point is sealed with a seal 8 which may be a metal O-ring.

Each of the boxes 3 is essentially composed of a plurality of smooth elongated straight tubes 10 which are arranged to form nests 9 of such tubes. The tubes 10 located within each given nest of tubes 9 are connected to a pair of tube plates 11 and 12 with the respective ends of the tubes 10 being inserted within the plates 11 and 12, as indicated in FIGS. 1*a* and 1*b*. The boxes or tubes nests are enclosed by a box guide shell 13 which extends longitudinally along the length of the tube nests 9. Adjoining the tube plates 11 and 12 are hemispherical collector hoods 14 and 15. The box guide shells 13 are open at the bottom, as shown in FIG. 1*b*, and they are connected at their upper ends directly to the tube plates 11, as seen in FIG. 1*a*. In this range they have a number of inlet slots 16 distributed over the circumference of the shells 13. Below the inlet slots 16 there is arranged a reinforcement frame 17 for the box guide shells 13 which is connected to the supporting grate 5 by lateral supports 18. The bottom ends of the box guide shells 13 are welded on the supporting grate 5.

The tube plates 11 with the respective collector hoods 14 operatively associated therewith, as well as the tube plates 12 with their respective collector hoods 15, are so arranged that they lie in different horizontal planes, these planes being labelled A, B, C and D, E, F, respectively. As indicated in FIGS. 1*a* and 1*b*, adjoining tube plates are staggered so that they are longitudinally spaced from an adjacent tube plate and so that, when seen in plan view, the tube plates overlap to a limited degree. As a result of this arrangement, individual boxes 3 may be placed closer together thereby minimizing the space necessary for the overall assembly.

The collector hoods 15 are connected to inlet pipe connections 19 for the inner medium, which is the present case is water, while the collector hoods 14 are connected to outlet pipe connections 20 for this medium. The access of the outer medium to the precooler is effected through a line 21 which opens above the collector hoods 14 into liner 2. The outer medium, which in the present case is helium, is conducted through the inlet slots 16 into the box guide shells 13 and flows in counterflow relationship to the water down along tubes 10 thereby giving off a great part of its heat content. Through a similar line, not shown, helium is conducted in the range below the collector hoods 15 out of the precooler.

Figure 2:
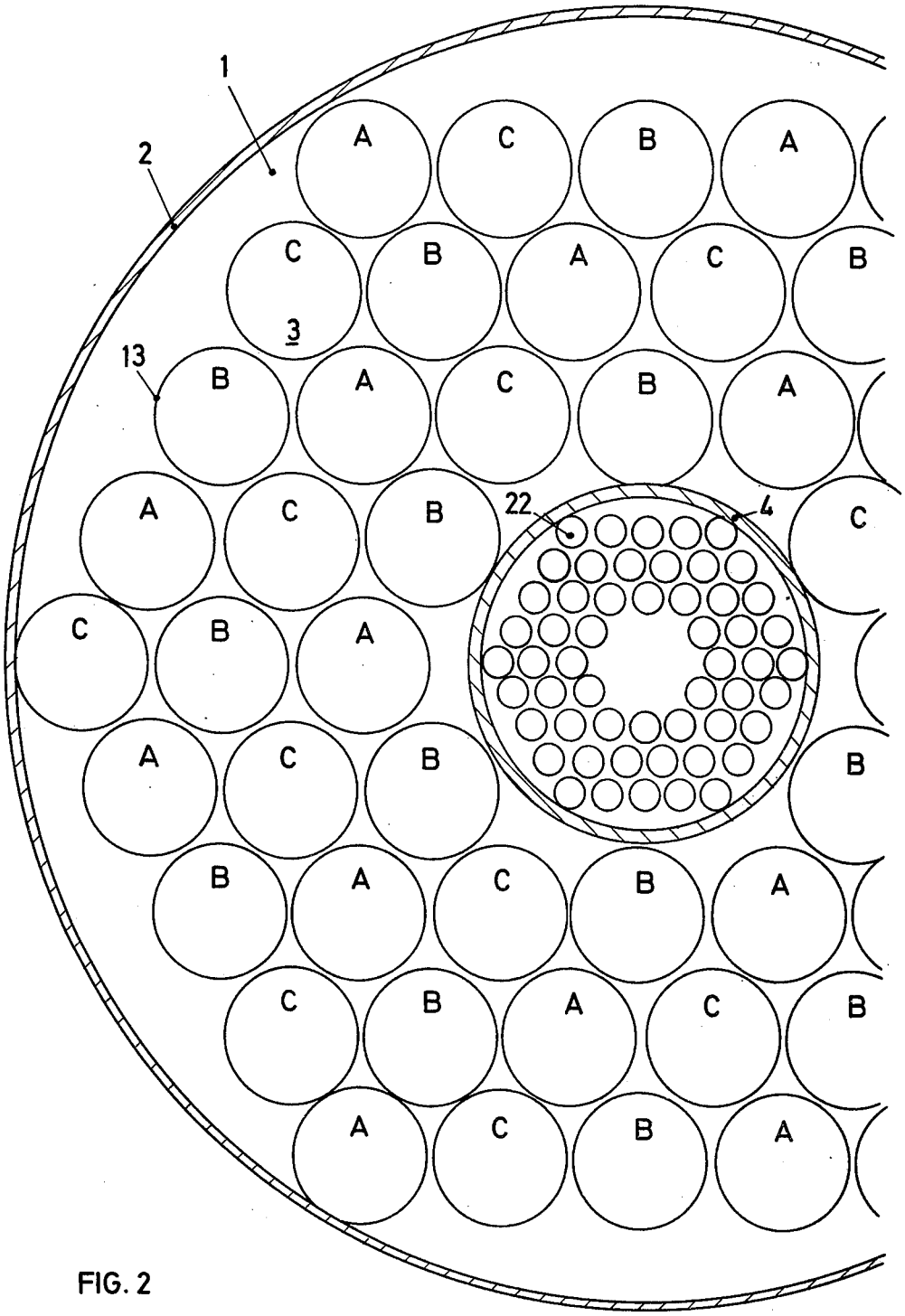
FIG. 2 is a sectional view taken through the line II—II of FIG. 1*b;*

As best seen in FIG. 2, the boxes 3 are arranged when seen in plan view in the form of a hexagonal grid. The arrangement is in accordance with the following formula:

$$n = 6 \sum^{i} i$$

In accordance with the formula indicated above, there is obtained 60 boxes for the cross section of the precooler with three boxed hexagons in accordance with:

$$n = 6\,(1 + 2 + 3 + 4).$$

If the innermost hexagon is not used for boxes, $n = 54$.

The free space in the center of the precooler is utilized for the return of the water flowing in the tubes 10. To this end, a number of return tubes 22 are arranged in parallel relationship to extend through the guide shell 4 with the tubes 22 entering the guide shell 4 at the top thereof through the hood 6. The return tubes 22 are welded to the hood 6 in order to prevent the appearance of undesired bypasses. The tubes 22 are likewise arranged in a hexagonal grid when seen in plan view, as indicated in FIG. 2. Each of the return tubes 22 is connected with one of the outlet pipe connections 20 by means of a U-tube 23. In this manner, thermal stresses between the outlet pipe connection 20 and the welds 24, which connect tubes 22 with hood 6 and which represent fixed points, are to a great extent avoided. After leaving the central guide shell 4 terminating at the level of the supporting grate 5, the return tubes 22 are connected on the circumference in the range of the outlet port (not shown) for the helium inside the precooler to the outside.

Figure 8:
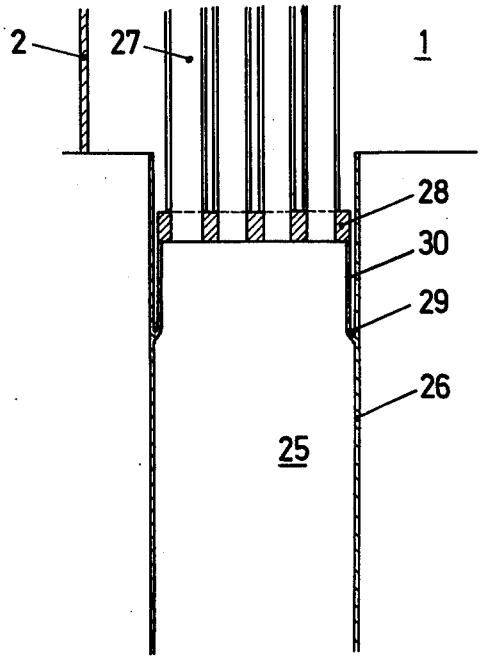
FIG. 8 is a sectional view taken along the line VIII—VIII of FIG. 7.
Figure 7:
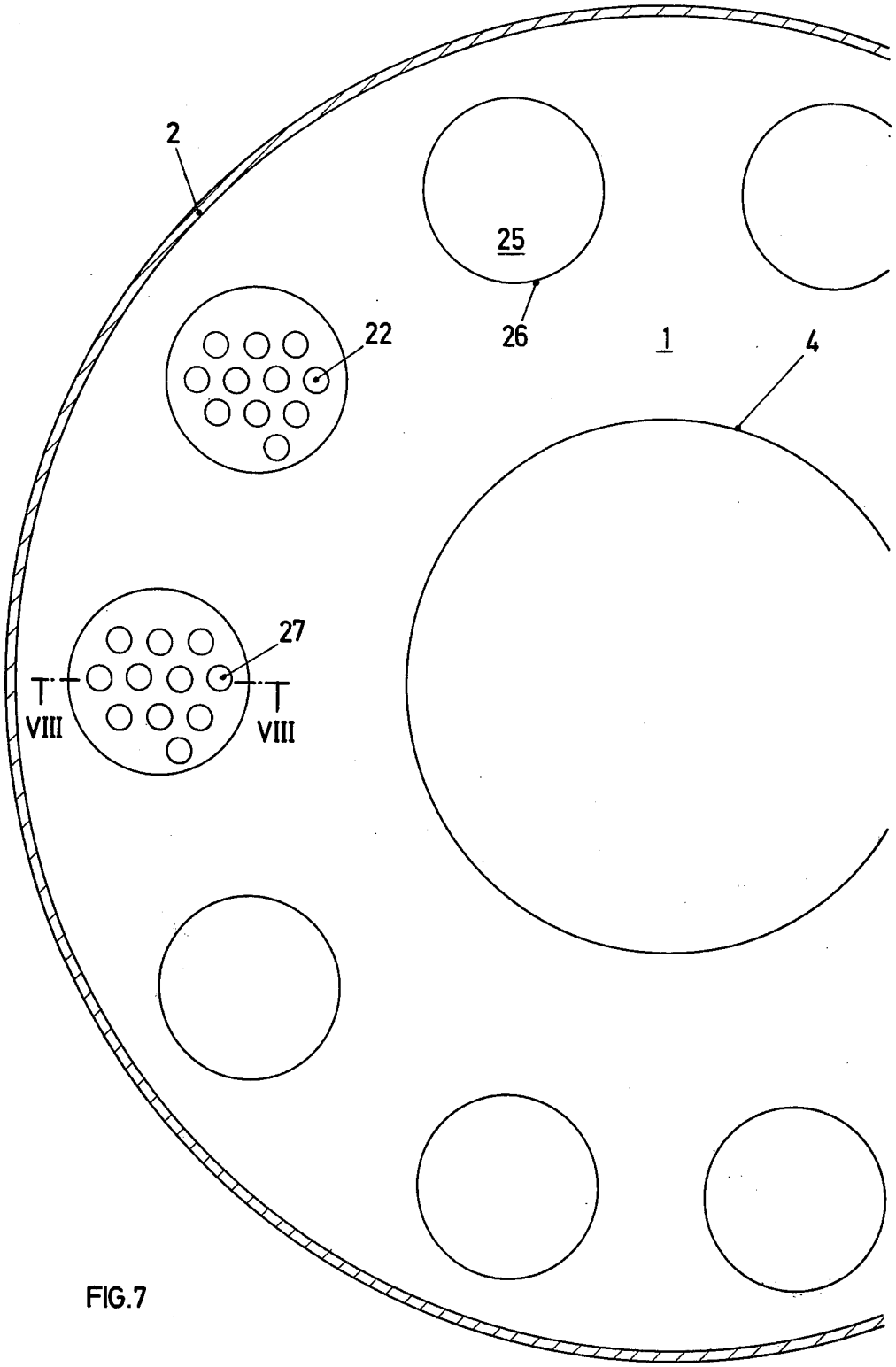
FIG. 7 is a sectional view taken through the precooler across the range of the bottom portion thereof.

FIGS. 7 and 8 show the manner in which the tubes 22 leave the precooler. In a pitch circle arranged about the extended vertical central axis of the precooler ten vertical openings 25 are provided through the prestressed concrete pressure tank which are lined with liners 26. In the openings 25 there are laid eleven tubes which serve to supply and return the water, the feed tubes 27 which are connected with the inlet pipe connection 19, and the return tubes 22 arranged in adjoining openings 25. The tubes 22 and 27, respectively, of each opening are inserted into a perforated plate 28 which is connected over a thermal sleeve 29 with the respective liner 26. The connecting point 30 is designed as a separating point to detach the tubes 22 and 27, respectively, from the bottom end and to disassemble individual boxes 3. Shielding of individual boxes 3 on the water side is likewise possible from the bottom through the openings 25. The shielding can be effected simultaneously on the inlet and outlet side, since the feed tubes 27 and the return tubes 22 are arranged on the same side of the precooler.

Figure 3:
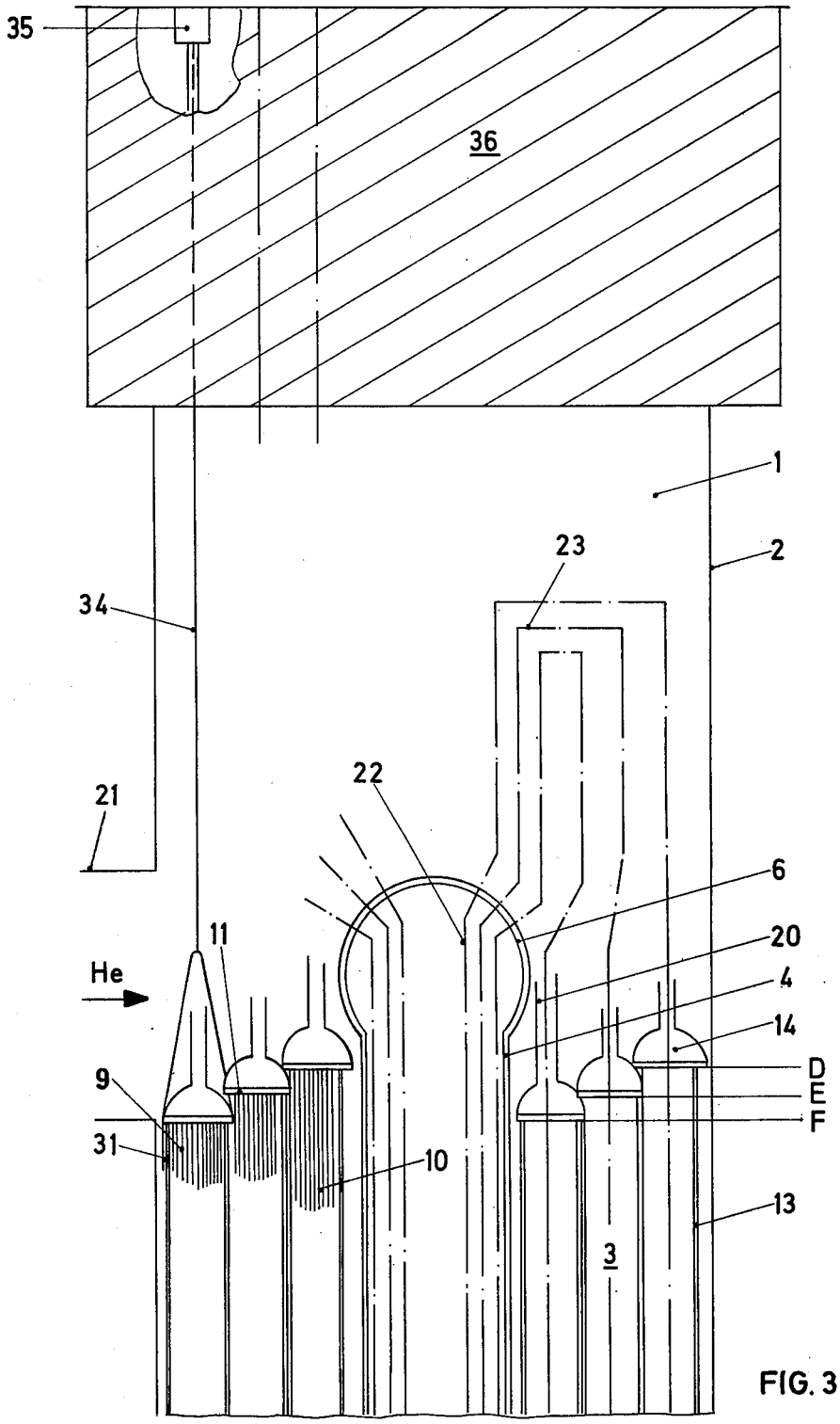
FIG. 3 is a longitudinal view partially in section showing the upper part of the precooler and depicting the draw-gear for actuating the cylinders covering the inlet openings of the guide shells.
Figure 4:
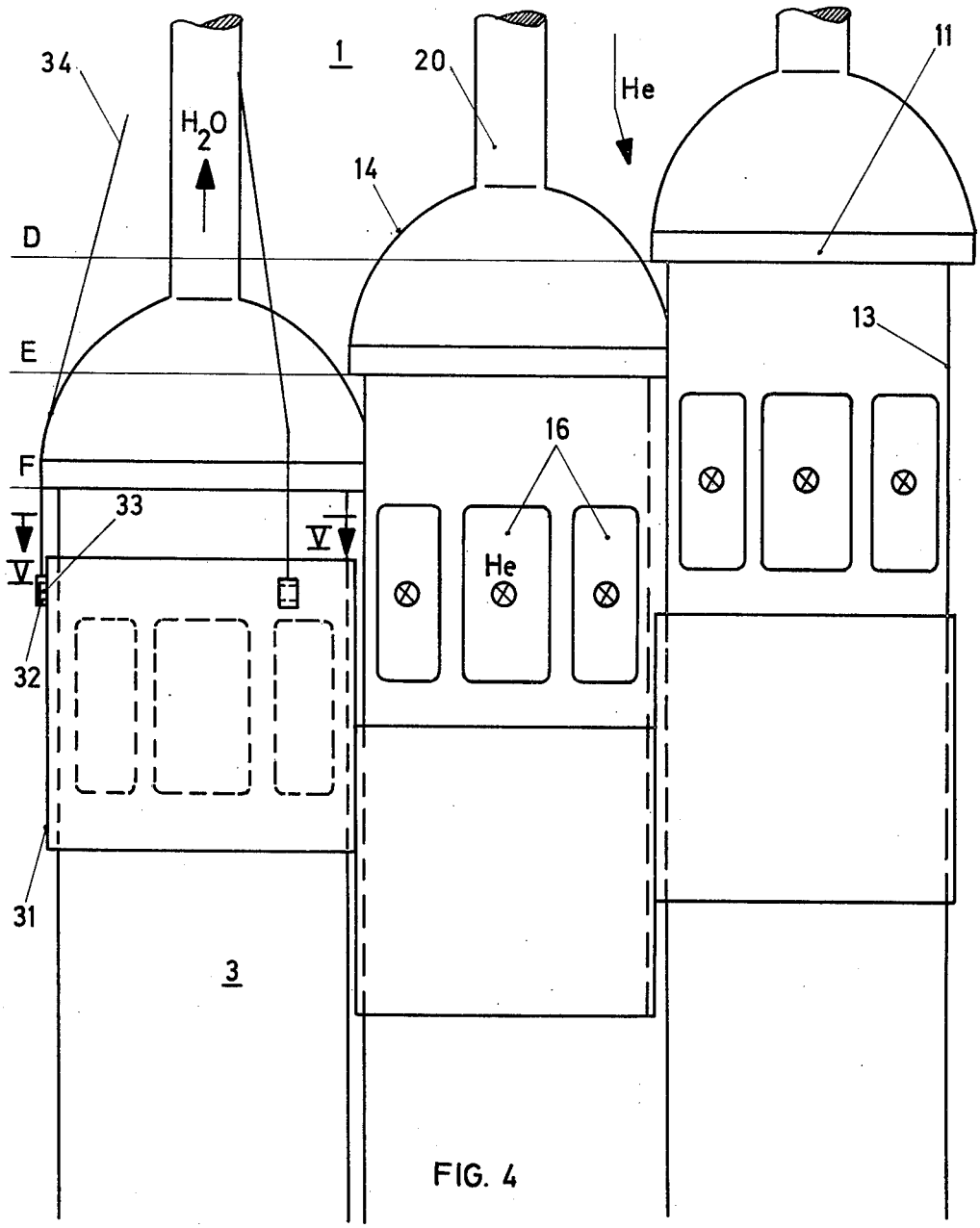
FIG. 4 is a schematic side elevation showing in an enlarged representation the upper portions of the boxes or guide shells of the tube nests.
Figure 5:
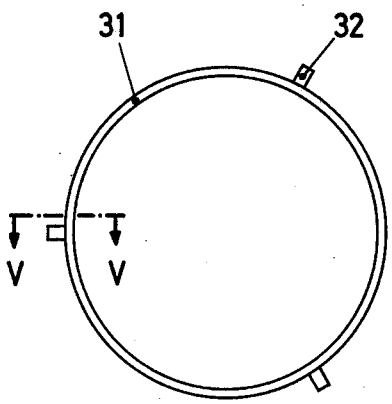
FIG. 5 is a sectional view taken along the line V—V of FIG. 4.
Figure 6:
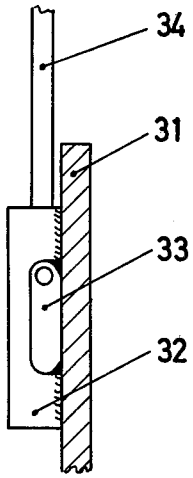
FIG. 6 is a sectional view taken along the line VI—VI of FIG. 5.

In order to shield individual tubes on the water side, there is provided in the upper part of the precooler a special device which permits shut-off of the helium to the inlet side. As shown in FIGS. 1*a* and 4, a cylinder 31 is movably mounted on each box guide shell 13 directly below the inlet slots 16. The cylinder is dimensioned with a height which is greater than the height of the inlet slots 16. The cylinders 31 may be raised upwardly by means of drawing gear shown in FIGS. 3 and 6 in order to completely cover the inlet slots 16 and thereby shut off helium flow therethrough. FIG. 1*a* shows all inlet slots 16 in the open condition while FIG. 4 shows one of the cylinders raised and the respective box 3 thus shielded on the helium side.

Each cylinder 31 has on its shell three lugs 32 provided with an oblong slot 33 in which there are secured the ends of a rope drive 34 branching downwardly. As seen in FIG. 3, the control means 35 for the rope drives 34 are installed in the outer surface of a concrete plug 36 with which pod 1 is closed. The accessibility of the means 35 is thus facilitated. Only one of these control means is represented in FIG. 3 but it will be apparent that other similar devices may be provided.

As described above, the embodiment represented in the drawings is a precooler arranged in the primary circuit of a high temperature reactor with a helium turbine. The two media which are in heat exchange relationship with each other are thus helium and water. The hot low pressure gas of about 550° C arriving from the turbine is first conducted on the shell side through a recuperator preceding the precooler in which it is cooled to about 250° C. At this temperature, it enters the precooler through line 21. Helium enters the boxes 3 through the inlet slots 16 and flows downwardly passed the tubes 10. During this flow period, the helium gives off a part of its heat content to the water flowing upwardly in the tubes 10 and is thus cooled to the lowest process temperature of 30° C. The helium then issuing from the precooler is fed to the low pressure compressor.

Water enters the precooler at the bottom through feed tubes 27 and flows through the inlet pipe connection 19 and the tube plates 12 into collector hoods 15 and is distributed there over to tubes 10 of the individual nests of tubes 9. When flowing upwardly through the tubes 10, the water absorbs heat from the helium conducted within the shells or boxes 3 and is collected again in collector hood 15 after passing through the tube plates 11. The water then proceeds on its further course through outlet pipe connection 20, U-shaped tubes 23 and return tubes 22 laid in the central guide shell 4. The latter emerge again from the precooler and the prestressed concrete pressure tank after passing through the vertical openings 25.

While a specific embodiment of the invention has been shown and described in detail to illustrate the application of the inventive principles, it will be understood that the invention may be embodied otherwise without departing from such principles.

What is claimed is:

1. A heat exchanger assembly of the counterflow type having a vertically extending longitudinal configuration comprising a plurality of individual tube nests each of said nests being formed of a plurality of individual tubes adapted to have a first heat exchange medium flow therethrough, tube plates connected to the ends of said tubes between which said tubes extend, a guide shell surrounding each of said tube nests for effecting therein flow of a secondary heat exchange medium around the individual tubes of said tube nest, each of said tube nests being formed by its associated guide shell and tube plates as individual boxes, said boxes thus formed, when viewed in a plane extending transversely to the longitudinal direction of said heat exchanger assembly, being arranged as a hexagonal grid, a supporting structure generally located in the bottom region of said vertically extending heat exchanger assembly and having said boxes welded thereto, a housing for said heat exchanger assembly surrounding said hexagonal grid of boxes and forming together with said supporting structure a tight joint to enclose said assembly, a central guide shell located centrally of said hexagonal grid and surrounded by said boxes, said central guide shell enclosing therein a plurality of return tubes for returning to said tubes forming said tube nests the heat exchange medium flowing therethrough, and a hood enclosing said central guide shell and having said return tubes extending therethrough with said return tubes welded to said hood.

2. A heat exchanger assembly according to claim 1 wherein said tube plates are arranged on opposite sides of said tube nests to lie in at least three different planes, said planes extending perpendicularly to the longitudinal direction of said heat exchanger, with said tube plates being positioned in such a way that adjacent tube plates are staggered and the tube plates overlap each other when viewed in said perpendicularly extending plane.

3. A heat exchanger assembly according to claim 2 including inlet and outlet pipe connections for said first heat exchange medium flowing in said individual tubes of said tube nests, and wherein said tube plates are adjoined by collector hoods which are connected to said inlet and outlet pipe connections for said first heat exchange medium.

4. A heat exchanger assembly according to claim 1 wherein said return tubes located in said central guide shell are arranged in a hexagonal grid as viewed in said transversely extending plane.

5. A heat exchanger assembly according to claim 3 wherein said return tubes are connected to said outlet pipe connections adjoining said collector hoods by tubes having a U-shaped form.

6. A heat exchanger assembly according to claim 3 wherein said second heat exchange medium enters the guide shells of said boxes from the upper ends thereof and is conducted around said nests of tubes within said boxes, with said first heat exchange medium being conducted through said individual tubes of said tube nests and being fed thereto from the bottom thereof through said inlet pipe connections and said collector hoods.

7. A heat exchanger assembly according to claim 1 wherein said guide shells of said boxes are connected at the top thereof directly to said tube plates and are provided with inlet slots through which said second heat exchange medium enters said boxes with said guide shells being open at the bottom thereof.

8. A heat exchanger assembly according to claim 7 wherein each of said guide shells of said boxes has a cylinder extending thereabout and arranged for verical displacement relative thereto said cylinder being movable to a first lower position to open said inlet slots and to a second raised upper position to cover said slots and to prevent flow therethrough, said assembly further comprising means mounted outside of said exchanger for raising and lowering said cylinders.

9. A heat exchanger assembly according to claim 1 adapted for use as a precooler in a nuclear power plant arranged under a prestressed concrete pressure tank which is installed in a pod lined with a liner, and wherein said supporting structure bears directly upon a thermosleeve provided on said liner, said bearing point therebetween being additionally sealed with a metal O-ring.

10. A heat exchanger according to claim 1 particularly adapted for use as a precooler in a nuclear power plant arranged under a prestressed concrete pressure tank and installed in a pod lined with a liner, said assembly including tubes for supplying said first heat exchange medium to said individual tubes of said tube nests, wherein said supply tubes and said return tubes for said first heat exchange medium are laid in several openings through the prestressed concrete pressure tank, said openings being arranged on a pitch circle extending about the center axis of said precooler.

11. A heat exchanger assembly according to claim 8 particularly adapted for use as a precooler in a nuclear plant arranged under a prestressed concrete pressure tank and installed in a pod lined with a liner, wherein said means for displacing said cylinders arranged on said guide shells of said boxes are mounted in a concrete plug provided to receive said precooler, said means being arranged to cooperate with a rope drive having rope branches above each of said collector hoods and being secured on the circumference of respective cylinders at several points thereon.

* * * * *